US005439175A

United States Patent [19]

Katayama

[11] Patent Number: 5,439,175

[45] Date of Patent: Aug. 8, 1995

[54] CLEANING DEVICE FOR A TUBE

[76] Inventor: Shinzou Katayama, 570-1 Oaza Kawano, Yoshikawa-machi, Kitakatsushika-gun, Saitama-ken, Japan

[21] Appl. No.: 200,042

[22] Filed: Feb. 22, 1994

[51] Int. Cl.[6] ..... B08B 9/04

[52] U.S. Cl. ..... 239/246; 239/251; 239/262; 239/DIG. 13; 134/167 R

[58] Field of Search ..... 239/225.1, 251, 252, 239/246, 262, DIG. 13; 134/167 C, 179, 167 R, 168 R, 172

[56] References Cited

U.S. PATENT DOCUMENTS

| | | | |
|---|---|---|---|
| 1,803,425 | 5/1931 | Cunningham | 239/DIG. 13 |
| 3,275,247 | 9/1966 | Hammelmann | 239/DIG. 13 |
| 3,656,694 | 4/1972 | Kirschke | 134/167 C |
| 3,702,685 | 11/1972 | Kirschke | 239/DIG. 13 |
| 5,143,105 | 9/1992 | Katayama | 134/167 C |

FOREIGN PATENT DOCUMENTS

| | | | |
|---|---|---|---|
| 3522593 | 1/1987 | Germany | 239/DIG. 13 |
| 1-315379 | 12/1989 | Japan . | |
| 469798 | 7/1975 | U.S.S.R. | 134/167 C |

*Primary Examiner*—Karen B. Merritt

*Attorney, Agent, or Firm*—Edwin E. Greigg; Ronald E. Greigg

[57] ABSTRACT

A self-propelled cleaning device for a tube where it does not revolve along the inner circumferential wall of the tube used as a piping when desired, and further permitting such a device to revolve along the inner circumferential wall of tube as an occasion demands. The cleaning device for a tube comprises a nozzle supporting body including a main flow path in an axial direction, and for self propelling having ejection holes in an oblique direction communicating with the main flow path formed on the upstream side to which a hose is connected. The main flow path communicates with a liquid supply path formed on the secondary side of a bearing portion for supporting a tubular revolving body having ejection holes for an unbalanced force. A slide valve is internally provided on the secondary side of the nozzle supporting body and is constantly forced in a valve seat direction by a spring member. A screw body is adapted for closing an opening portion on the front end side of the nozzle supporting body; and a valve limiting member is provided at the screw body and adapted for adjusting a spring force of the spring member so that the slide valve can be moved away from the valve seat in correspondence with a pressure of a pressure medium flowing into the upstream side.

6 Claims, 10 Drawing Sheets

CLEANING DEVICE FOR A TUBE

BACKGROUND OF THE INVENTION

This invention relates to a cleaning device for a tube used as piping, which is used at the time of cleaning a factory or industrial piping or a sewage piping by making use of high pressure water.

Hitherto, one example of a cleaning device for a tube used as piping of this kind is disclosed in the Japanese Patent Application Laid Open No. 315379/1989 (Tokkaihei 1-315379) (U.S. Pat. No. 5,143,105).

The cleaning device disclosed in this example was previously proposed by the inventor of this invention. This device comprises a tubular nozzle supporting body to which an insertion end portion of a hose is attached, a nozzle rotatably supported by the nozzle supporting body and having injection holes for unbalanced forces, which are directed to the inner wall of the tube, and an elongated nozzle guide member integrally attached to the nozzle and adapted to guide the nozzle along the inner circumferential wall of the tube.

However, in the above-mentioned configuration, the nozzle revolves along the inner circumferential wall of the tube all the time. When the nozzle is caused to revolve all the time, in the case where there is a relatively large split offset in the inner wall of the tube used as a piping, there were instances where the inner wall of the tube became cracked or the guide member was damaged because of the large split in the piping.

SUMMARY OF THE INVENTION

In view of drawbacks with the prior art as described above, a first object of this invention is to allow a cleaning device for a tube to be only self-advanced or self-propelled in the case where there is any split offset at the inner wall of a tube used as a piping.

A second object of this invention is to move a slide valve in correspondence with pressure of a pressure medium force-fed from a hose, thereby permitting a cleaning device for a tube to revolve along the inner wall of the tube used as piping while allowing the cleaning device to be automatically self-advanced or self-propelled.

A third object of this invention is to permit a cleaning device for a tube to be smoothly guided along the inner circumferential wall of the tube used as piping.

To achieve these objects, in accordance with this invention, there is provided a cleaning device for a tube, comprising a nozzle supporting body including a main flow path in a shaft axial direction, and having an ejection hole or holes for self-propelling in an oblique direction. The ejection hole or holes communicate with the main flow path formed on the upstream side to which a hose is connected, and a liquid supply path communicates with the main flow path formed on the downstream side of a bearing portion for supporting a tubular revolving body having an ejection hole or holes for unbalanced forces. A slide valve is internally provided at the downstream side of the nozzle supporting body and biased in an axial direction all the time by a spring member. A screw body is adapted for closing an opening portion on the front end side of the nozzle supporting body; and a valve limiting member is provided at the screw body and adapted for adjusting a spring force of the spring member so that the slide valve can be away from the seat in correspondence with pressure of a pressure medium flowing into the upstream side.

BRIEF DESCRIPTION OF THE DRAWINGS

FIG. 1 is a cross sectional schematic explanatory view of the state where a device of this invention is sell-propelled and not revolved;

FIG. 2 is an explanatory view showing the appearance of the device of this invention;

FIG. 3 is an explanatory view showing the state where the device of this invention is self-propelled and revolved;

FIG. 4 is an explanatory view showing the state where the device of this invention is revolved;

FIG. 5 is a cross sectional schematic explanatory view of the state where the device of this invention is self-propelled and revolved;

FIG. 6 is a schematic explanatory view of the cross section in the state where a device of this invention is self-propelled and not revolved;

FIG. 7 is an explanatory view showing the appearance of the device of this invention;

FIG. 8 is an explanatory view showing the state where the device of this invention is self-propelled and revolved;

FIG. 9 is an explanatory view showing the state where the device of this invention is revolved;

FIG. 10 is an explanatory view showing the slide valve part of the device of this invention.

DETAILED DESCRIPTION OF THE PREFERRED EMBODIMENTS

Figure 1:
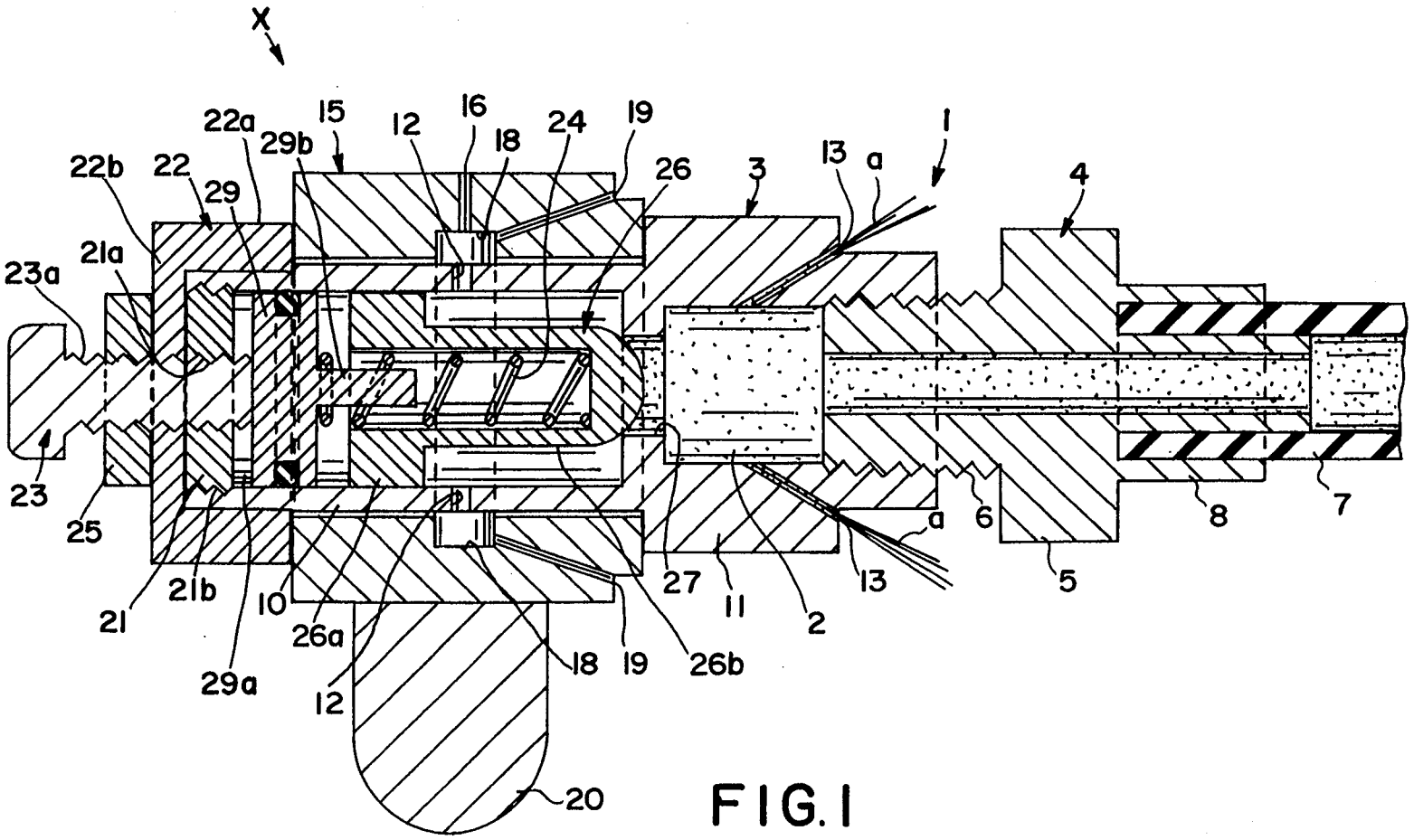
FIGS. 1 to 5 show a first embodiment of this invention.
Figure 2:
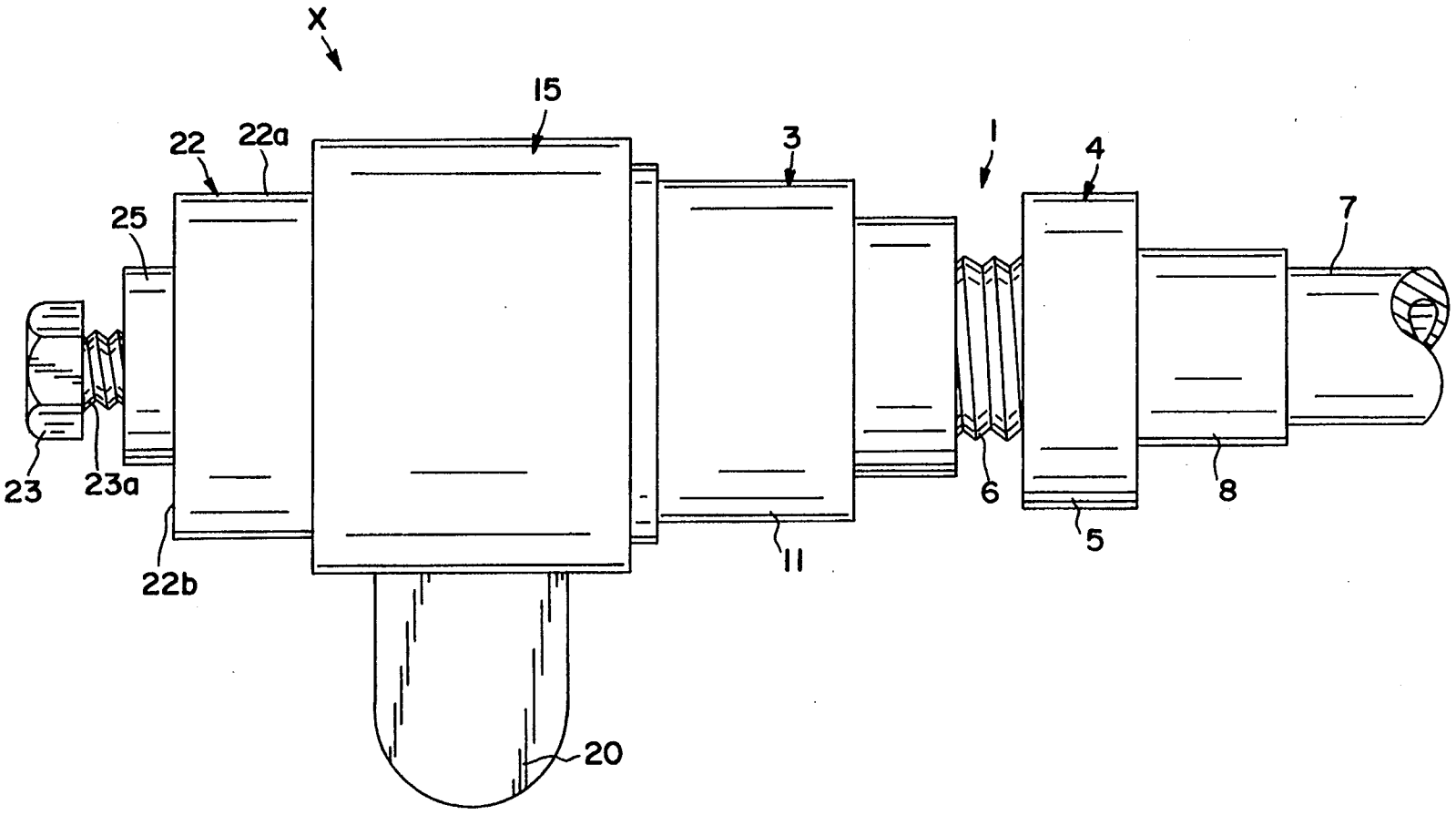
Figure 3:
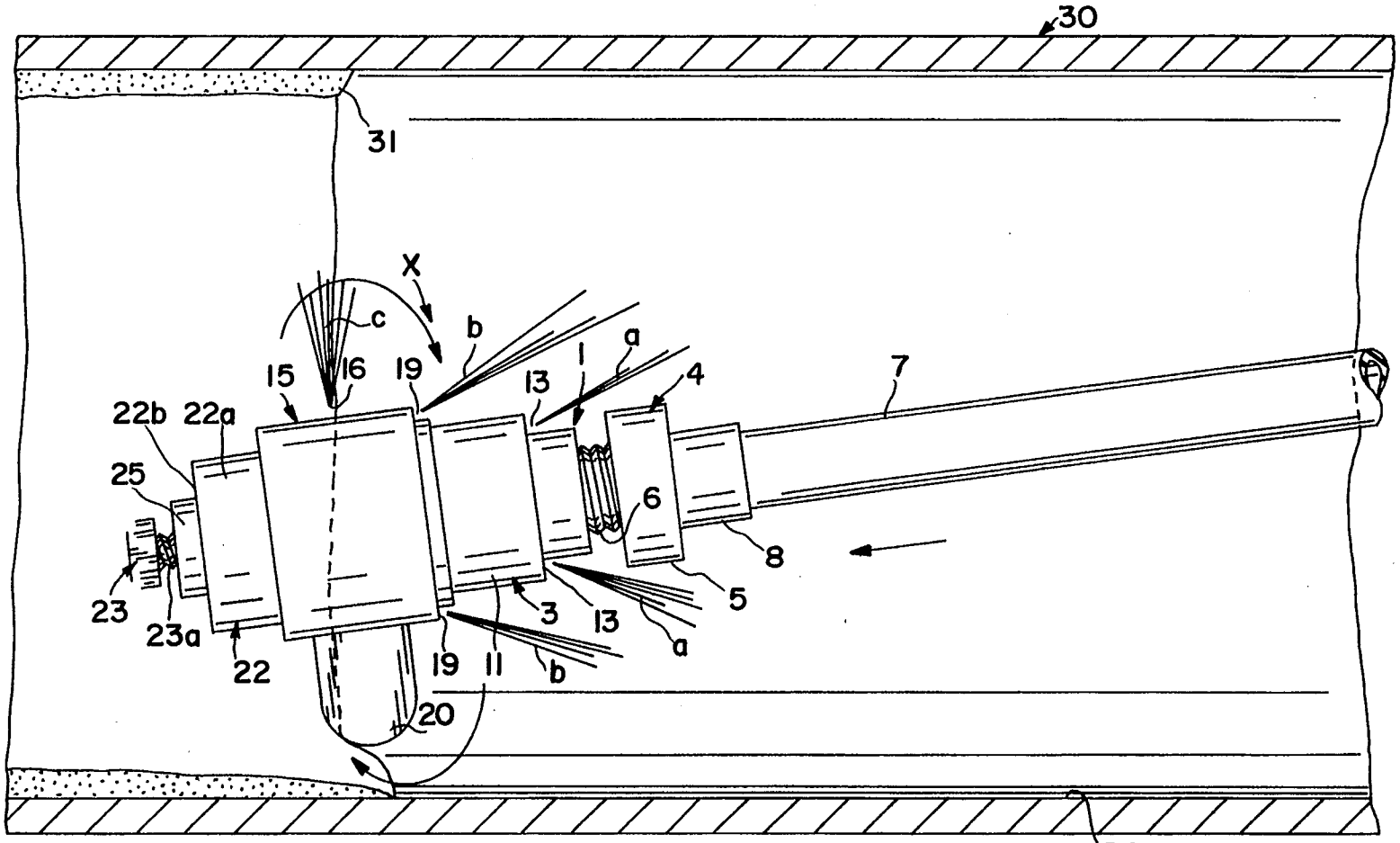

FIGS. 1 to 5 show a cleaning device X for a tube according to a first embodiment of this invention.

Reference numeral 1 denotes a tubular nozzle supporting body. This nozzle supporting body 1 comprises, in this embodiment, a tubular body 3 having a main flow path 2 in a shaft center direction, and a tubular metal fitting 4 for attachment of a hose 7 which is screw connected to the tubular body 3. The hose attachment metal fitting 4 includes, at the central portion thereof, a flange portion 5 circumferentially provided, a male screw portion 6 screw connected to the tubular body 3 formed on the front end side, and an attachment portion 8, adapted so that one end portion of a hose 7 is fitted thereinto, formed on the rear side.

The tubular body 3 of the nozzle supporting body 1 is, when viewed in a divisional manner, composed of a tubular bearing portion 10 formed on the front end side and a liquid (fluid) injection portion 11 of a large diameter connected to the bearing portion 10.

Reference numeral 12 denotes a plurality of liquid supply paths formed at the bearing portion 10 so as to communicate with the main flow portion 2 in a direction perpendicular thereto. These flow supply paths 12 are disposed in a radial direction of the bearing portion 10 with a predetermined circumferential spacing therebetween. Further, reference numeral 13 denotes a plurality of first ejection holes for self-propelling formed at the liquid injection portion 11 so as to communicate with the main flow path 2 in an oblique direction. Such injection hole 13 for self-propelling may be formed also at the hose attachment metal fitting 4.

Figure 5:
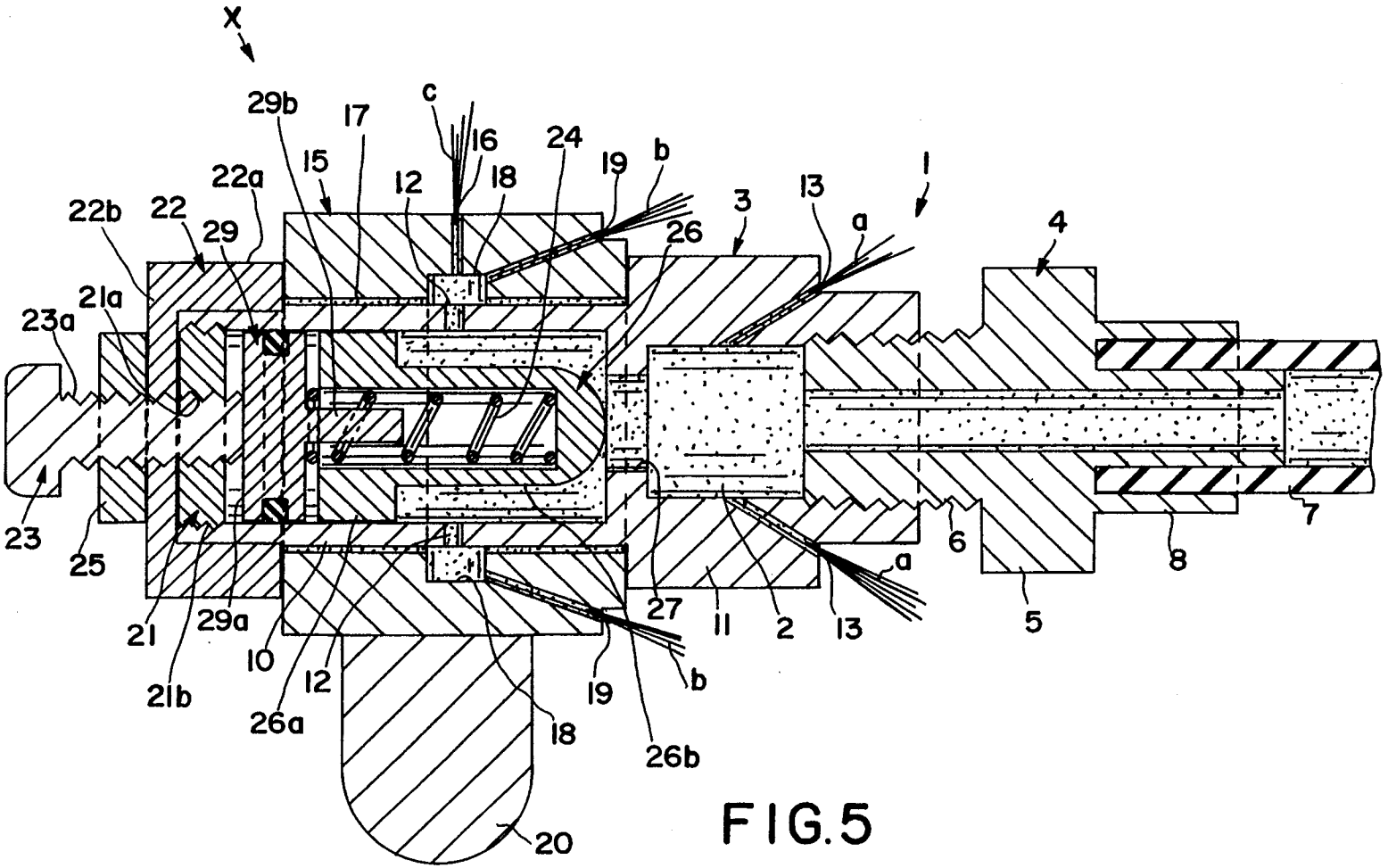
Figure 6:
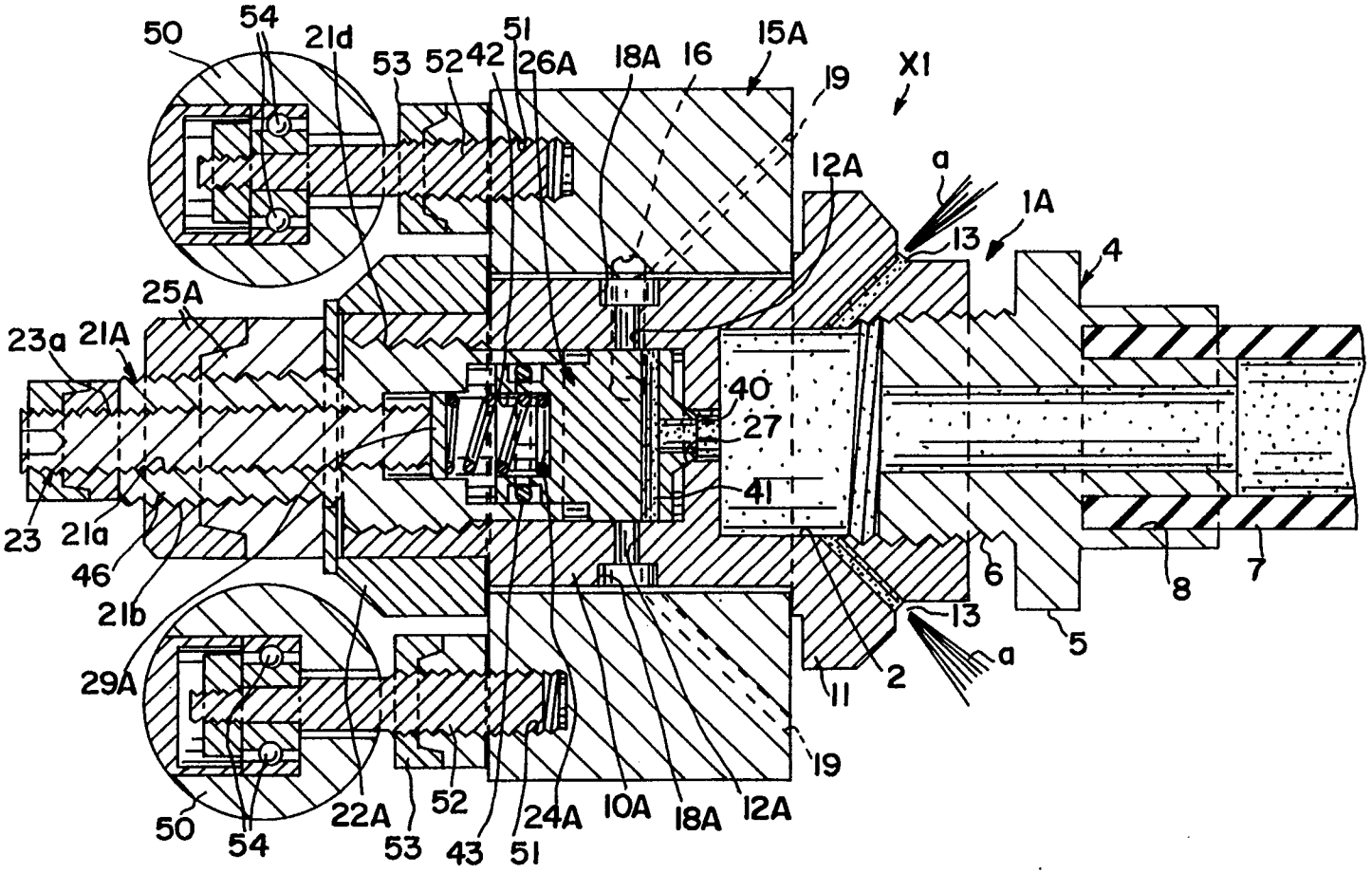
FIGS. 6 to 10 show a second embodiment of this invention.
Figure 7:
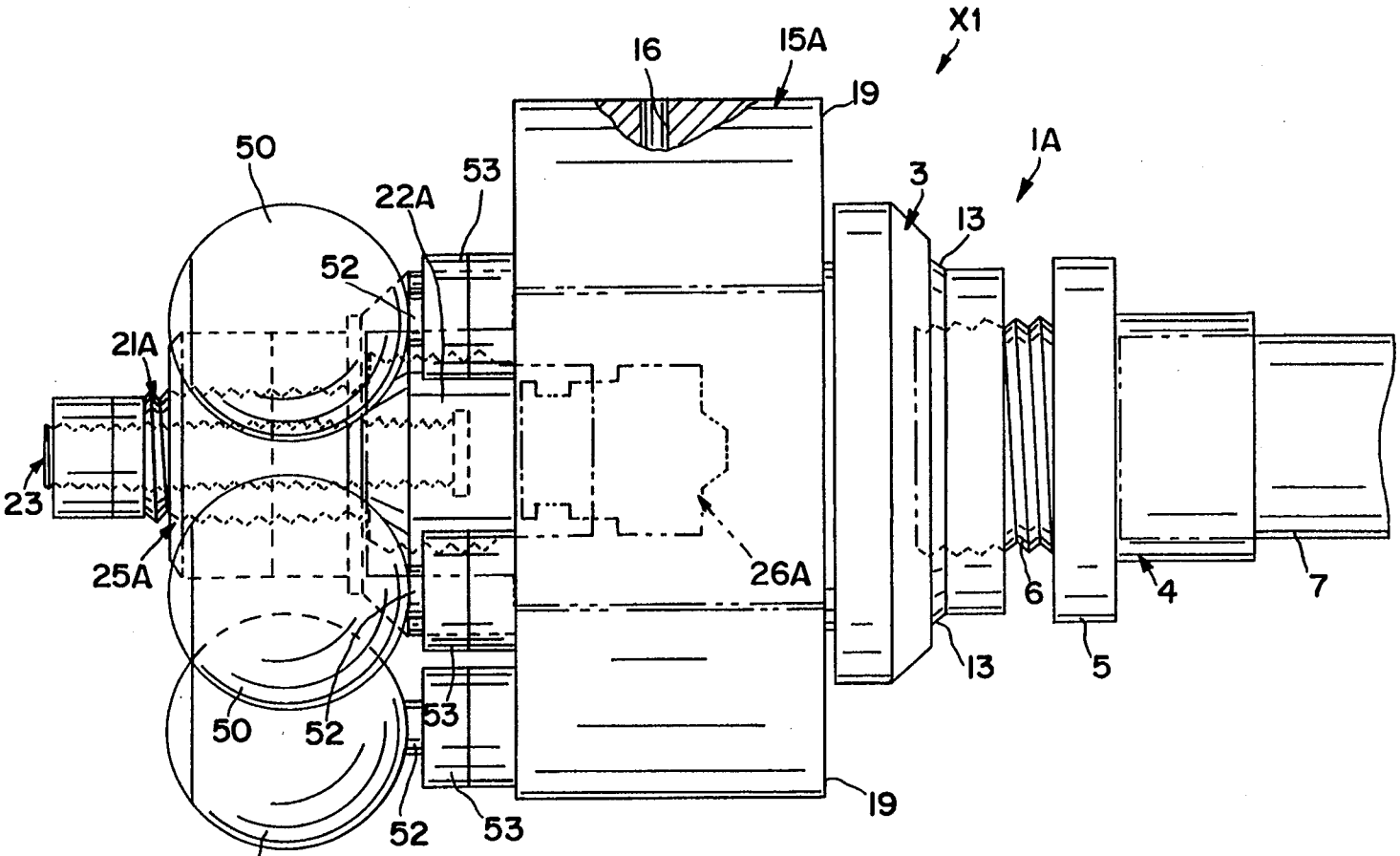
Figure 8:
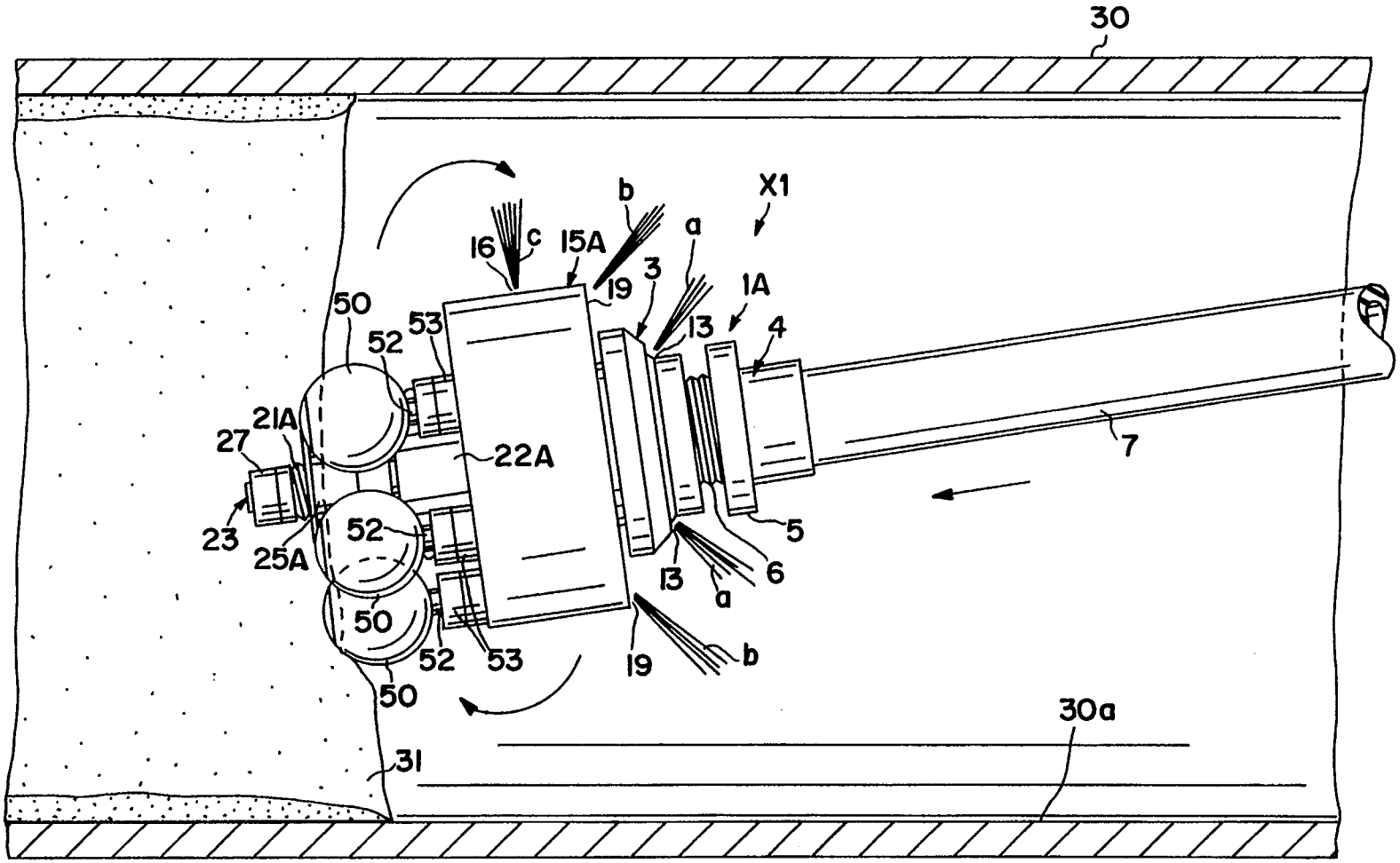

Reference numeral 15 denotes a tubular revolving body fitted over the nozzle supporting body 1 which revolves along the inner circumferential wall of a tube used as piping by an ejection force of liquid through ejection holes 16 for an unbalanced. This revolving body 15 is a sort of a nozzle member. In this embodiment, the revolving body 15 is formed so that it has a diameter greater than that of liquid ejection portion 11 of the tubular body 3 of the nozzle supporting body 1. Further, as shown in FIG. 5, the revolving body 15 is loosely fitted over bearing portion 10 of the tubular body 3 so that a water layer 17 having a bearing function can be formed. As occasion demands, revolving body 15 may be provided at nozzle supporting body 1 through a bearing.

Reference numeral 18 denotes a liquid (fluid) reservoir in a form of a groove formed in the inner circumferential wall of the revolving body 15. This liquid reservoir 18 is provided so that it can communicate with the liquid supply paths 12 of the bearing portion 10. The liquid reservoir 18 is an annular groove opposite to the liquid supply paths 12. It is to be noted while liquid reservoir 18 is formed at the inner circumferential wall of the revolving body 15 in this embodiment, it may be formed at the outer circumferential wall of the bearing portion 10 of the nozzle supporting body 1 as in a second embodiment which will be described later.

While a single hole or a plurality of holes may be provided as ejection hole 16 for an unbalanced force, it is desirable to form a plurality of holes at suitable positions in order to sufficiently exhibit an unbalanced force to revolving body 15 and a cleaning function with respect to a tube used as piping.

Each ejection hole 16 communicates with liquid supply paths 12 in a direction perpendicular thereto. Further, while revolving body 15 is formed cylindrical (tubular) in this embodiment, it may be flat as a whole in order to render a guide function to the revolving body itself. Accordingly, in the case where the revolving body is flat in shape, the guide portion which will be described is not required.

Reference numeral 19 denotes a plurality of second ejection holes for self-propelling formed at the revolving body 15 so as to communicate with the liquid reservoir 18 in an oblique direction.

Reference numeral 20 denotes a guide portion in a tongue form provided integrally with the circumferential body portion of the revolving body 15. Any shape of the guide portion 20 may be employed. For example, in addition to the tongue shape, there may be adopted rod shape, long plate shape, flat plate shape, semi-circle shape or U-shape. By taking the position of the ejection hole 16 for an unbalance force into consideration, guide portion 20 of the revolving body is provided at the position on the opposite side to the ejection hole 16.

Reference numeral 21 denotes a disk-shaped screw body adapted for closing the opening portion on the front end side of the nozzle supporting body. This screw body 21 includes female threads 21*a* along the central portion, and a male screw threads 21*b* screw connected on the outer circumference to female threads formed at the inner circumferential wall of the opening portion 10.

Reference numeral 22 denotes a holding member in the form of a cap which is externally fitted over the front end portion of bearing portion 10. At an annular portion 22*b* connected to a circumferential body portion 22*a* of the holding member 22, an axial fitting hole in correspondence with the center hole of the screw body 21 is formed.

Reference numeral 23 denotes a valve limiting member provided at the female screw 21*a* of screw body 21 and adapted for adjusting or regulating a spring force of a spring member 24 so that the slide valve can be moved away from a valve seal 27 in correspondence with a pressure of the pressure medium flowing into the primary side of the plan medium. As this valve limiting member 23, an adjustment bolt having a male screw portion 23*a* screw connected to female screw 21*a* of the screw member 21 is used in this embodiment. Reference numeral 25 denotes a lock nut screw connected to the male screw portion 23*a* of valve limiting member 23.

Reference numeral 26 denotes a slide valve caused to be in a form of projection as a whole. This slide valve 26 is composed of a piston portion 26*a* which slides on the inner circumferential wall of bearing portion 10, and a hollow portion 26*b* projected in a valve seat 27 direction of the main flow path 2 from the piston portion. It is to be noted that it is not necessarily required that slide valve 26 be in a form of projection, but spool valves in various forms may be employed for this purpose.

Reference numeral 29 denotes a spring supporting member internally fitted into the secondary side of bearing portion 10 of nozzle supporting body 1, and adapted for supporting the projection end portion of spring member 24 inserted into hollow portion 26*b* of the slide valve 26. This spring supporting member 29 is composed of a disk-shaped O-ring seal portion 29*a*, on one side surface, with which the insertion end portion of male screw portion 23*a* of valve limiting member 23 is in contact, and a columnar spring supporting portion 29*b* provided in such a manner that it is projected at the central portion on the other side surface of the seal portion.

In the above-described configuration, in the case where an attempt is made to allow cleaning device X for a tube to be merely self-advanced or self-propelled as it is without allowing it to revolve during cleaning within a tube used as piping, pressure of the pressure medium force-fed through the hose is weakened.

Thus, as shown in FIG. 1, the seal member 29 slides toward the upstream side of the nozzle supporting body 1 against the spring force of spring member 24. As a result, the spring force of spring member 24 powerfully acts on slide valve 26 so that slide valve 26 is pushed toward the seat 27 side. Thus, the spherical portion of hollow portion 26*b* of slide valve 26 comes into force-contact with seat 27. As a result, cleaning water which has flowed into the primary side is interrupted by slide valve 26, and is ejected from first ejection holes 13 for self-propelling.

Accordingly, cleaning device X for a tube is self-advanced or self-propelled by a jet a of the ejection holes 13 for self-propelling, whereas, since no cleaning water is supplied to the liquid supply path 12 of the nozzle supporting body 1, revolving body 15 does not revolve along the inner circumferential wall of tube 30 used as a piping.

On the other hand, in the case where an attempt is made to further revolve cleaning device X for a tube along the inner circumferential wall of tube 30 used as a piping from the state where it is self-advanced or self-propelled, pressure of a pressure medium is force-fed through the hose and is enhanced in a manner opposite to the above.

Thus, as shown in FIG. 5, slide valve 26 is moved away from seat 27. As a result, cleaning device X for the tube is not only self-advanced or self-propelled to the depth of tube 30 used as a piping by jet a ejected from ejection holes 13 for self-propelling, but also a portion of cleaning water flows into the secondary side of nozzle supporting body 1. Such Cleaning water is passed through the liquid supply paths 12 and liquid reservoir 18, so that jet b is injected from the second ejection holes 19 for self-propelling of revolving the body 15.

Meanwhile, cleaning water which has flowed into the secondary side of the main flow path 2 is first passed through the liquid supply paths 12, and forcibly flows into the liquid reservoirs 18, resulting in a standing state. At the same time, cleaning water flows into the gap between the outer circumferential wall of bearing portion 10 and the inner circumferential wall of revolving body 15, thus forming a water layer 17 having a bearing function.

Figure 4:
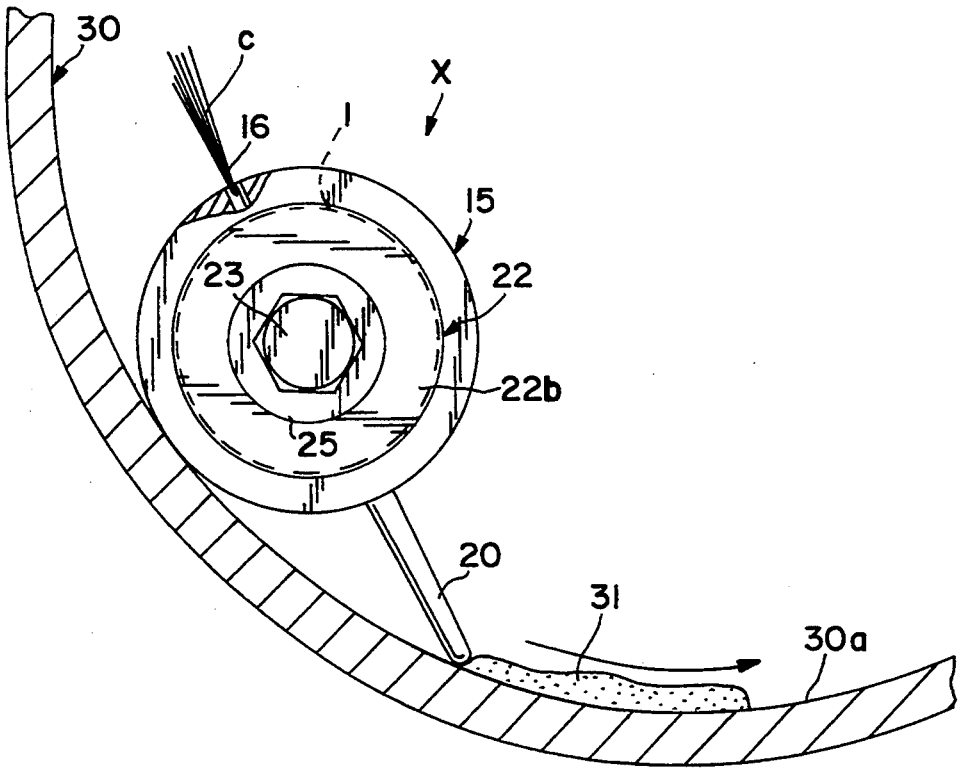

As shown in FIG. 4, cleaning device X for a tube is thrust or pushed toward the inner wall 30*a* of tube 30 used as a piping by reaction force of jet c ejected from ejection holes 16 for an unbalanced force through the liquid reservoir 18, and then revolves, on the other hand, along the inner circumferential wall of the tube 30 as a piping while being smoothly guided by guide portion 20 positioned in a revolving direction.

By cleaning water injected from ejection holes 13, 19 for self-propelling and ejection holes 16 for unbalanced forces, deposit 31 within tube 30 is removed.

A second embodiment of this invention will now be described with reference to FIGS. 6 to 10. It is to be noted that the same or like reference numerals are respectively attached to the same portions as those of the first embodiment of this invention, and their repetitive explanation is omitted here.

Cleaning device X1 for a tube of the second embodiment, first mainly differs from the above-mentioned cleaning device X for a tube in that a liquid reservoir 18A is formed at the outer circumferential wall of bearing portion 10A of nozzle supporting body 1A. Also in this embodiment, liquid reservoir 18A may be formed at the inner circumferential wall of revolving body 15A.

Secondly, the shape of slide valve 26A is different. At one end portion side of slide valve 26A, an axial hole 40 is formed in a slide direction. Further, at the central portion of slide valve 26A, a diametrical liquid guide hole 41 is formed in a direction intersecting with the center hole. This liquid guide hole 41 can communicate with liquid supply path 12A. At the other end side of slide valve 26A, a spring accommodating portion 42 adapted to receive one end portion of spring member 24A is formed. At the outer circumferential wall of the spring accommodating portion 42, an annular groove is formed. In the annular groove, an O-ring 43 is provided.

Thirdly, the shapes of screw body 21A and spring supporting member 29A are different. Screw body 21A is caused to be in a bolt form as a whole, and includes a large diameter portion 45 and a small diameter portion 46 connecting thereto. Further, spring supporting member 29A is formed disk-shaped, and is provided so that it can slide within the large diameter portion 45. It is to be noted that a plurality of lock nuts 25A are screw connected to the small diameter portion 46 of the screw body 21A.

Fourthly, the shape of holding member 22A is different. This holding member 22A is formed merely tubular.

Figure 9:
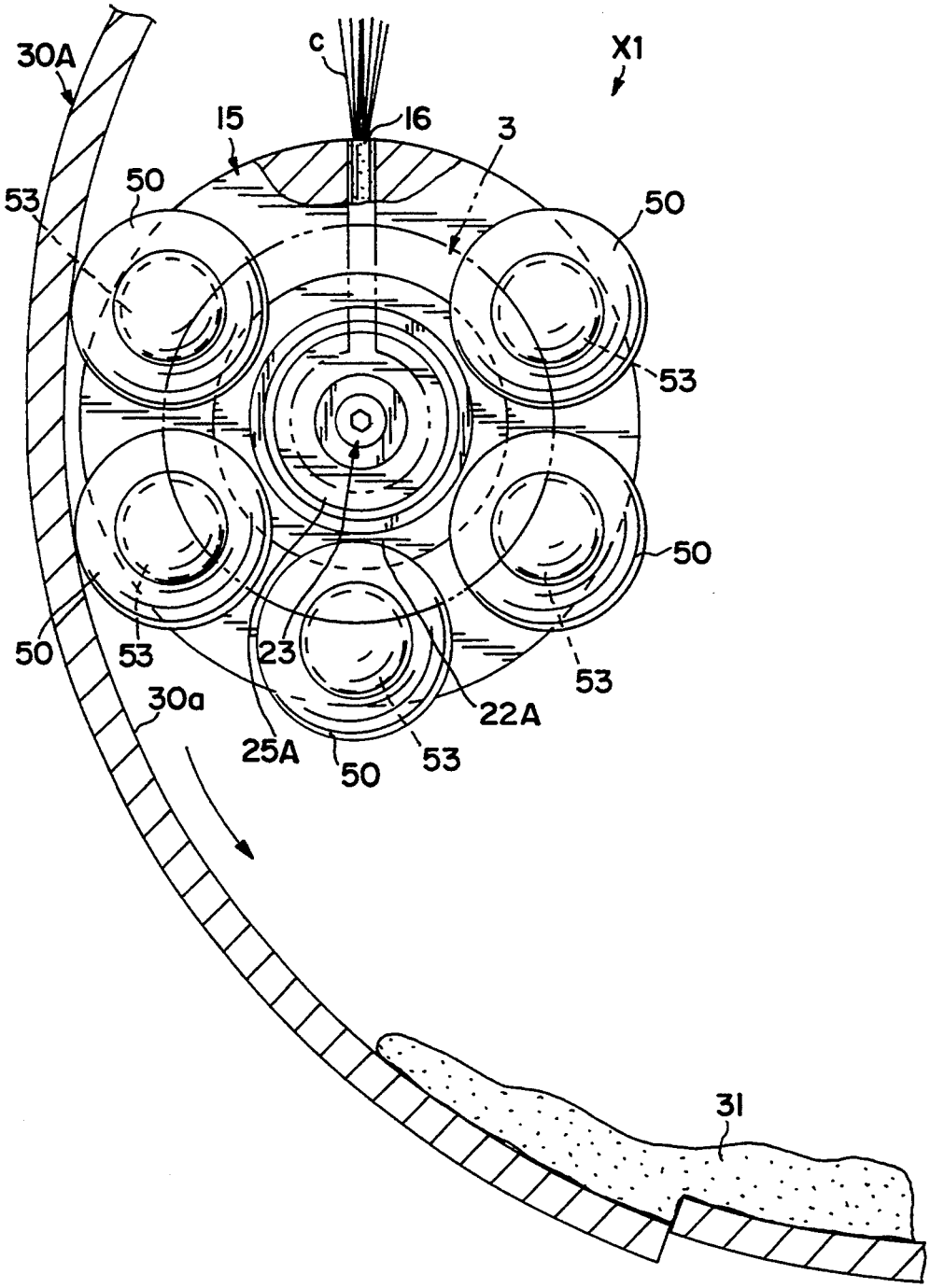
Figure 10:
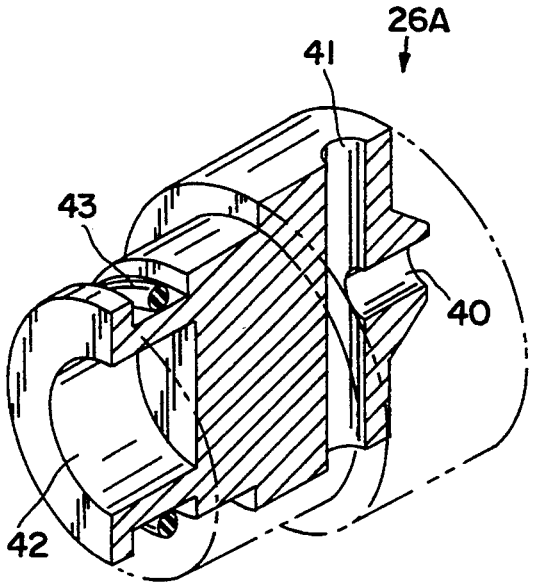

Fifthly, this embodiment differs from the first embodiment in that a plurality of guide rotary bodies 50 are attached on revolving body 15A. As shown in FIG. 9, this guide rotary body 50 slides on the inner circumferential wall of tube 30A used as piping and guides the cleaning device X1 for tube.

Respective rotary bodies 50 are disposed on revolving body 15A through a plurality of female screws 51 formed at the front wall portion of revolving body 15A and screw rods 52 respectively are screw connected to the female screws.

Additionally, reference numeral 53 denotes a plurality of lock nuts, and rotary body 50 is supported by screw rod 52 through a mini-bearing 54.

Also in the case where cleaning device is constructed as above, the same effects/advantages as those of the first embodiment of this invention are provided.

As apparent from the foregoing description, in this invention, it is possible to allow cleaning devices for a tube to be self-advanced or self-propelled during cleaning in the state where it does not revolve along the inner circumferential wall of a tube as a piping. As occasion demands, it is possible to further revolve the cleaning device for a tube along the inner circumferential wall of the tube as a piping.

What is claimed is:

1. A cleaning device for a tube comprising:

a nozzle supporting body including a main flow path in a shaft axial direction, said nozzle supporting body having at least one injection hole for self-propelling said nozzle supporting body in an oblique direction and communicating with the main flow path formed on an upstream side of said nozzle supporting body to which a hose is connected, and a liquid supply path that communicates with the main flow path formed on a secondary side of a bearing portion for supporting a tubular revolving body having at least one injection hole for an unbalanced force; a slide valve internally provided at the secondary side of the nozzle supporting body and biased constantly in a valve seat direction by a spring member; a screw body adapted for closing an opening portion on a front end side of the nozzle supporting body; and a valve limiting member provided at the screw body and adapted for adjusting a spring force of the spring member so that the slide valve can be moved away from the valve seat in correspondence with a pressure of a pressure medium flowing into the upstream side.

2. A cleaning device for a tube as set forth in claim 1, wherein a spring supporting member is interposed between the valve limiting member and the spring member.

3. A cleaning device for a tube as set forth in claim 1, wherein the revolving body is provided on the nozzle supporting body and includes a liquid layer having a bearing function.

4. A cleaning device for a tube as set forth in claim 1, wherein a further revolving body (50) is provided on the tubular revolving body through a mini-bearing.

5. A cleaning device for a tube as set forth in claim 1, wherein the revolving body is formed so that its diameter is greater than that of the nozzle supporting body.

6. A cleaning device as set forth in claim 5, wherein the revolving body includes a guide portion provided in a projected manner.

* * * * *